US011662089B2

(12) United States Patent
Villermin et al.

(10) Patent No.: US 11,662,089 B2
(45) Date of Patent: May 30, 2023

(54) LIGHTED DECORATIVE ARTICLE

(71) Applicant: Williams-Sonoma, Inc., San Francisco, CA (US)

(72) Inventors: Jenny Leigh Villermin, San Francisco, CA (US); Amanda Whitley Edwards, San Francisco, CA (US)

(73) Assignee: Williams-Sonoma, Inc., San Francisco, CA (US)

( * ) Notice: Subject to any disclaimer, the term of this patent is extended or adjusted under 35 U.S.C. 154(b) by 0 days.

(21) Appl. No.: 17/672,831

(22) Filed: Feb. 16, 2022

(65) Prior Publication Data

US 2022/0260246 A1 Aug. 18, 2022

Related U.S. Application Data

(60) Provisional application No. 63/149,842, filed on Feb. 16, 2021.

(51) Int. Cl.

| | |
|---|---|
| ***F21V 33/00*** | (2006.01) |
| ***F21S 9/02*** | (2006.01) |
| ***F21V 23/00*** | (2015.01) |

(52) U.S. Cl.

CPC ..... *F21V 33/0028* (2013.01); *F21S 9/02* (2013.01); *F21V 23/001* (2013.01)

(58) Field of Classification Search

CPC ..... F21V 33/0028; F21V 33/0008; F21V 23/001; F21S 9/002; F21S 9/02; F21L 4/02; A47G 33/08; A47G 2033/0827

See application file for complete search history.

(56) References Cited

U.S. PATENT DOCUMENTS

| | | | | |
|---|---|---|---|---|
| 4,823,240 | A * | 4/1989 | Shenker | A41D 27/08 362/108 |
| 5,523,741 | A * | 6/1996 | Cane | A47G 33/00 36/137 |
| 8,992,038 | B2 * | 3/2015 | Smith, III | F21V 9/00 362/570 |
| 9,706,803 | B2 * | 7/2017 | Rapisarda | F21V 21/002 |
| 2004/0264213 | A1 * | 12/2004 | Davis | G02B 6/0006 362/565 |
| 2015/0305414 | A1 * | 10/2015 | Garbrick | G02B 6/0005 362/570 |

* cited by examiner

*Primary Examiner* — Peggy A Neils

(74) *Attorney, Agent, or Firm* — Cook Alex Ltd.

(57) ABSTRACT

A lighted decorative article includes an outer layer of material with a batting layer attached to the outer layer. The outer layer includes a number of light source apertures. A light source wiring harness includes a number of light sources operatively connected by electrical wire. The light sources are positioned within the light source apertures of the outer layer, and the electrical wire is secured to the batting layer. A liner is secured to the batting layer so as to cover the wire.

10 Claims, 7 Drawing Sheets

LIGHTED DECORATIVE ARTICLE

CLAIM OF THE PRIORITY

This application claims the benefit of U.S. Provisional Application No. 63/149,842, filed Feb. 16, 2021, the contents of which are hereby incorporated by reference in their entirety.

FIELD OF THE INVENTION

The present disclosure relates generally to decorative articles and, in particular, to a lighted decorative article.

BACKGROUND

Lighted decorative articles, such as stockings, are popular holiday decorations. Such stockings are often hung, such as on a fireplace mantle, and filled with treats and/or small gift items. Lighted stockings that provide an attractive and unique appearance are especially desirable. In addition, economical and efficient production of such stockings is also desirable.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a lighted decorative article including an outer layer of material and a batting layer attached to the outer layer, where the batting layer includes a number of light source apertures. A light source wiring harness includes a plurality of light sources operatively connected by electrical wire. The plurality of light sources are positioned within the plurality of light source apertures and the electrical wire is secured to the batting layer. A liner is secured to the batting layer so as to cover the wire.

In another aspect, a method of manufacturing a lighted decorative article includes the steps of: forming a plurality of light source apertures in a batting layer; securing the batting layer to an outer layer; inserting a plurality of light sources into the light source apertures of the batting layer; securing wiring operatively connected to the plurality of light sources to the batting layer; and securing a lining to the batting layer so that the wiring is sandwiched between the batting layer and the lining.

DETAILED DESCRIPTION OF EMBODIMENTS

Figure 1:
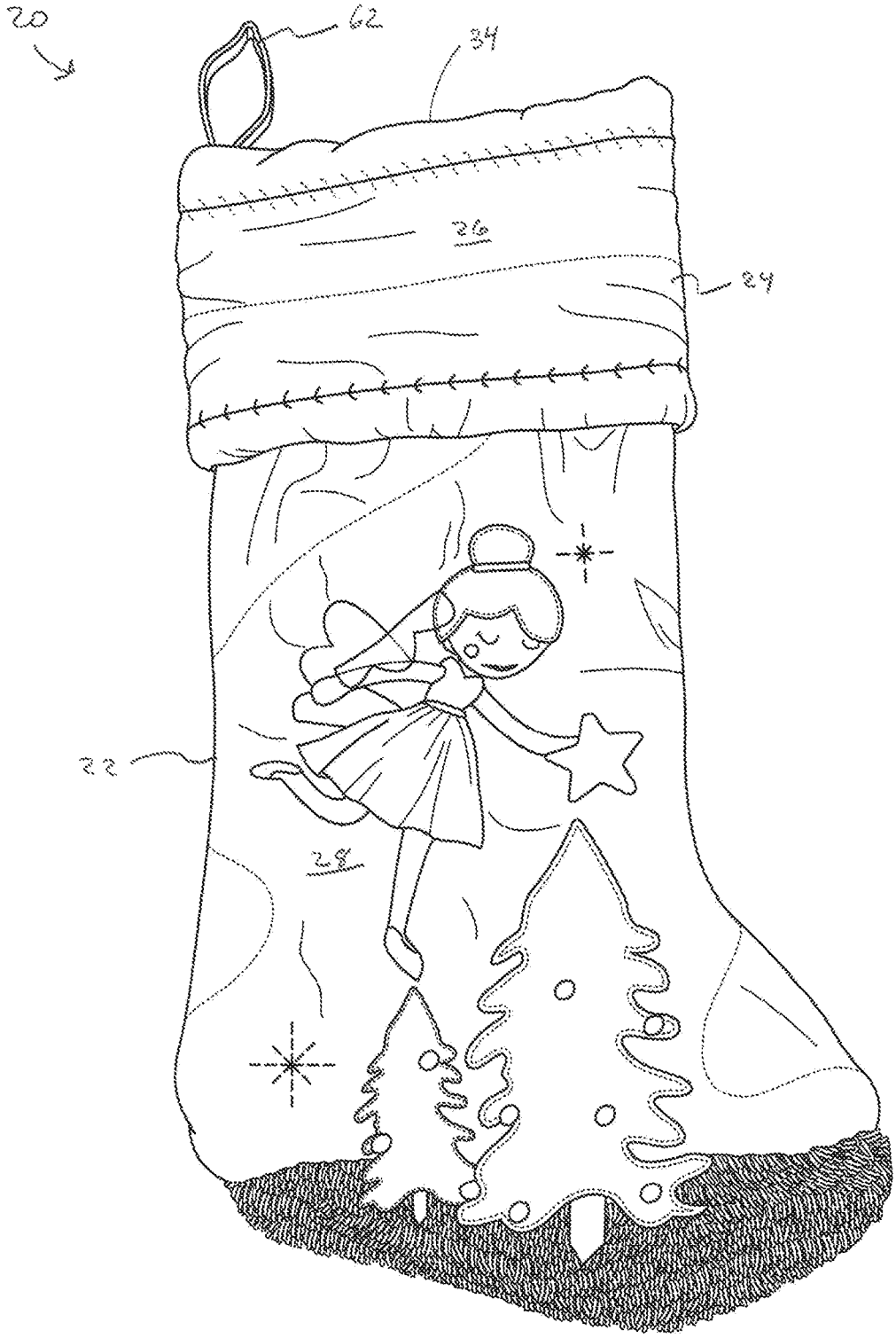
FIG. 1 is a side perspective view of an embodiment of the lighted decorative article of the disclosure in the form of a lighted stocking.
Figure 2:
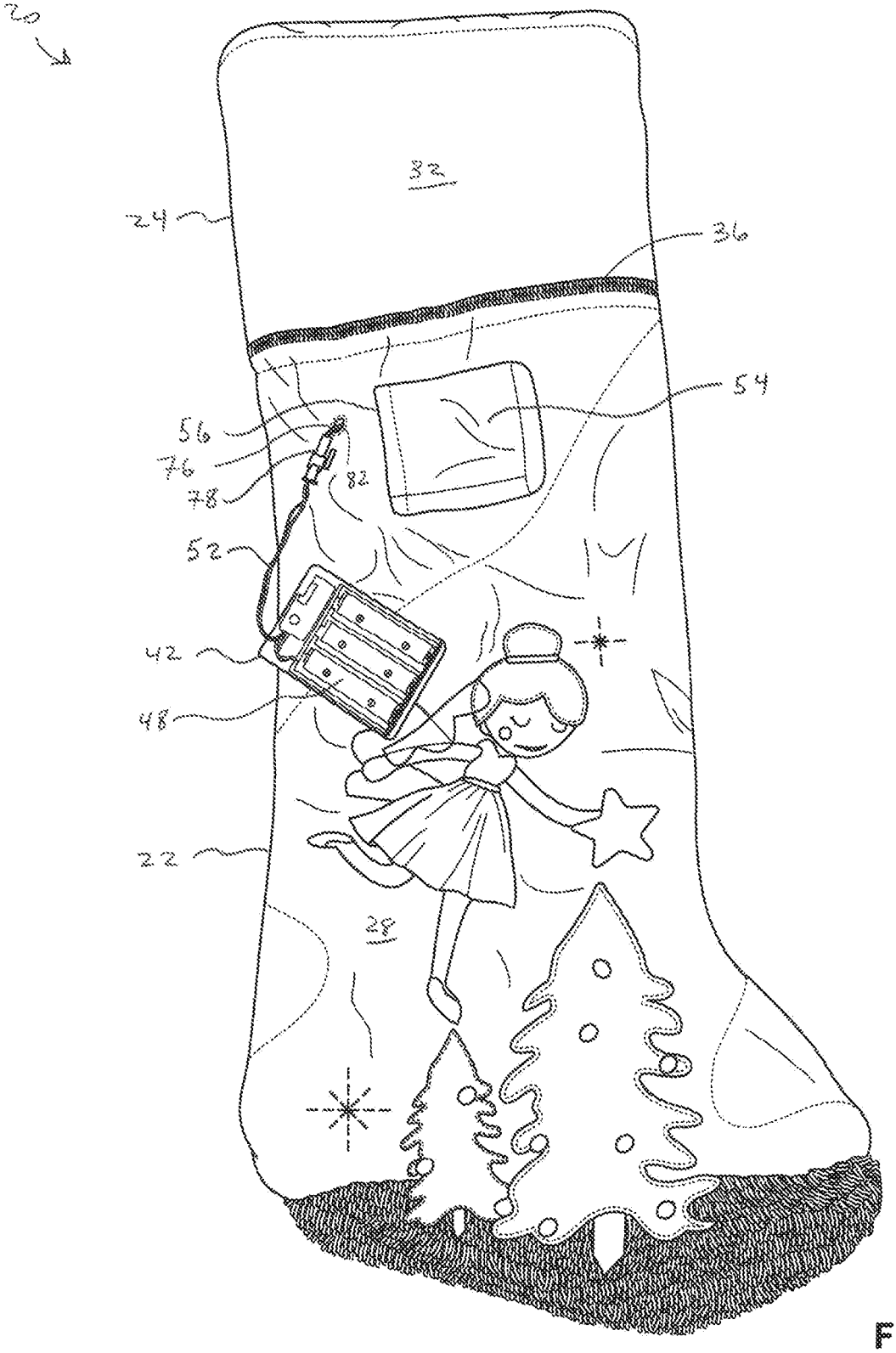
FIG. 2 is a side perspective view of the lighted stocking of FIG. 1 with the cuff raised and the battery pack removed from the battery pack holder pocket.

An embodiment of the lighted decorative article of the disclosure in the form of a lighted stocking is indicated in general at 20 in FIGS. 1 and 2. While the invention is described in terms of a lighted stocking, the lighted decorative article of the invention may take other forms.

The stocking 20 includes a body 22 and an annular cuff 24. The cuff includes an exterior surface 26 (FIG. 1) and an interior surface 32 (FIG. 2). The body 22 includes an outer layer having an exterior surface 28. As is known in the art, the body defines an interior that is accessible via an opening 34 in the top of the stocking.

As is illustrated in FIG. 2, the top edge of the body 22 is attached to an edge of the cuff 24 via stitching 36 so that the cuff surrounds the stocking opening 34 (FIG. 1). In an alternative embodiment, the cuff portion 24 may be integrally formed with the body portion 22 so that the two portions share a single piece of cloth. In addition, in an alternative embodiment, the cuff 24 may not completely surround the opening 34 of the body 22 of the stocking.

As shown in FIG. 1, the cuff 24 folds down over the top portion of the stocking body 22 in an overlaying fashion so that the interior surface 32 (FIG. 2) of the cuff lays against the top portion of the outer layer exterior surface 28 of the body 22.

As illustrated in FIG. 1, a loop 62 is secured to the top portion of the body 22 so that the stocking may be easily hung for display and use.

As will be explained in greater detail below, the body 22 of the stocking is provided with a number of light sources, such as light emitting diode (LED) bulbs, that are visible through the exterior surface 28. This may be accomplished by the outer layer (featuring exterior surface 28) being constructed of a sheer cloth, such as cotton sheeting, with the light sources being positioned underneath the cloth (as in the illustrated embodiment and described below). Alternatively, or in addition, the exterior surface 28 may be provided with openings so that the light sources are visible, or the light sources may be attached on top of the exterior surface 28. Alternative types of light sources known in the art may be used in place of the LED bulbs. The light sources may be of a single color or multiple colors.

Power for the light sources is provided, with reference to FIG. 2, by a battery pack 42. As an example only, the battery pack may hold a number of replaceable battery cells 48 that provide electrical power to the light sources via electrical wire 52.

Figure 3:
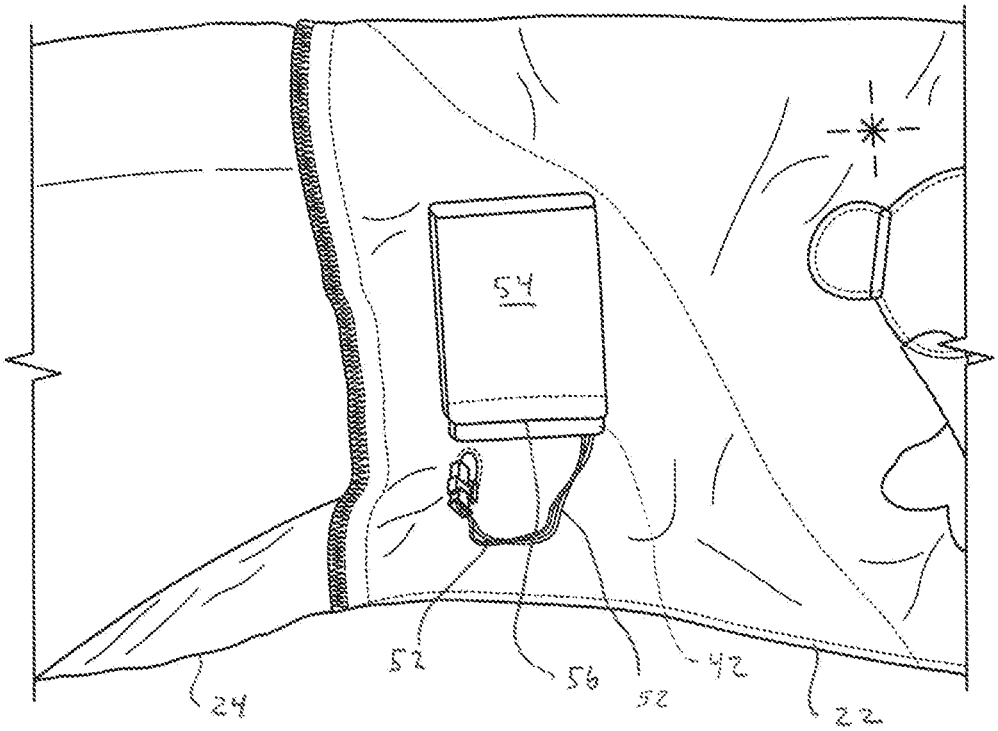
FIG. 3 is an enlarged side perspective of the battery holder pocket of FIG. 2 with the battery pack positioned therein.

As illustrated in FIGS. 2 and 3, a battery pack holder in the form of a pocket 54 having an opening 56 is provided on the top portion of the body portion 22 of the stocking and is sized to receive and hold the battery pack 42 so that it is concealed under the cuff 24 when it is overlaying the top portion of the body 22 (as illustrated in FIG. 1). This permits easy replacement of the batteries. The battery pack may include a power switch to activate the light, as well as other features such as a timer and/or blinking selector.

In an alternative embodiment, the pocket may be formed on the interior surface 32 of the cuff 24. In addition, alternative arrangements for the battery pack holder for securing the battery pack under the cuff 24 may be used in place of the pocket 54. These may include hook and loop fasteners, one or more straps, netting, webbing, etc.

Figure 4:
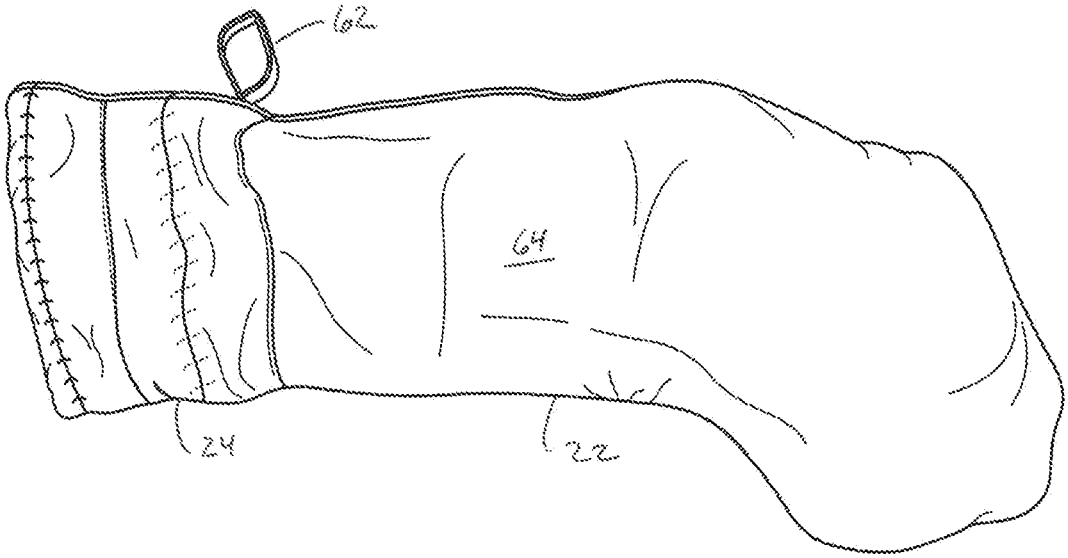
FIG. 4 is a side perspective view of the lighted stocking of FIGS. 1 and 2 turned inside out.

FIG. 4 illustrates the stocking of FIGS. 1 and 2 after being turned inside out. As a result, the lining 64 of the body 22 is visible. As an example only, the lining 64 may be constructed of polyester fabric.

Figure 5:
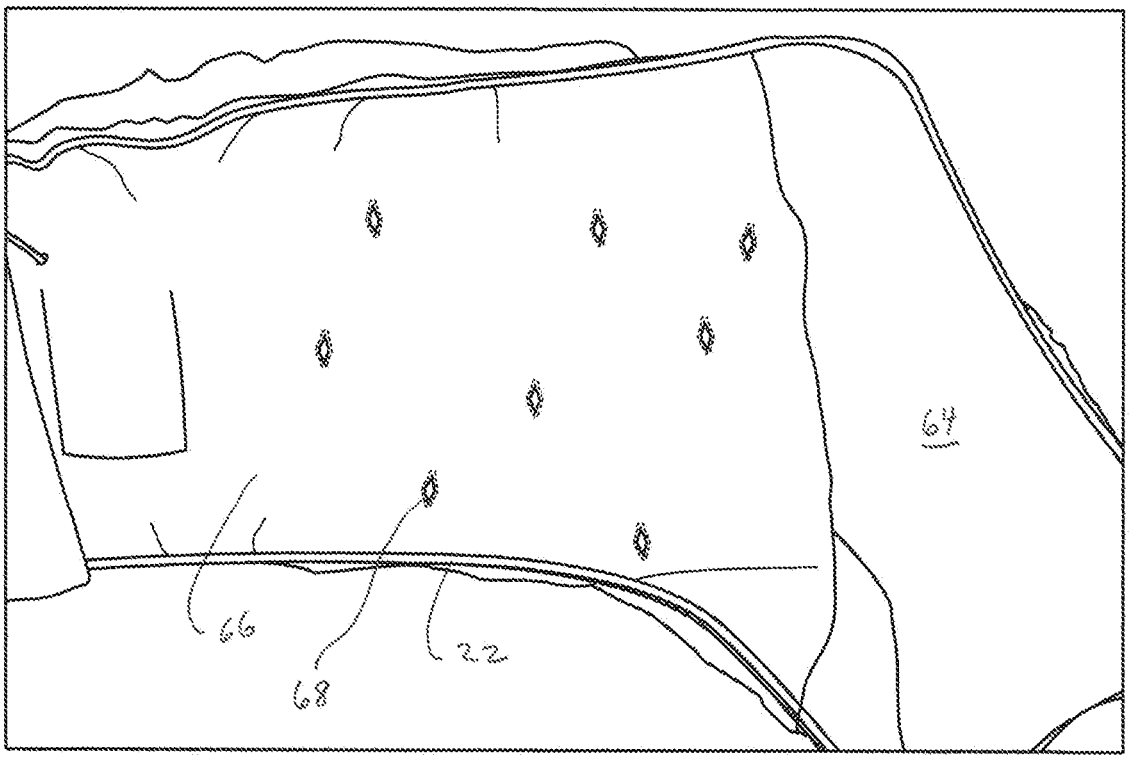
FIG. 5 is an enlarged side perspective view of the batting layer of the stocking of FIG. 4.

FIG. 5 illustrates the interior of the stocking body 22 with a portion of lining 64 removed and prior to the installation of the LED lighting and corresponding wiring. A batting layer 66 is visible and features light source apertures 68. While eight light source apertures are illustrated, the batting layer 66 may feature an alternative number of such apertures. As an example only, the batting layer 66 may be constructed from cotton batting.

The outer layer (which includes the exterior surface 28 of FIG. 1) and the batting layer 66 of FIG. 5 may be quilted together prior to installation of the light sources and associated wiring. In addition, the quilted fabric may be garment washed and/or subjected to other cloth conditioning processes to improve the appearance of the completed stocking.

After the outer layer and batting are quilted and washed/processed, the lighting sources and corresponding wiring may be added thereto.

Figure 6:
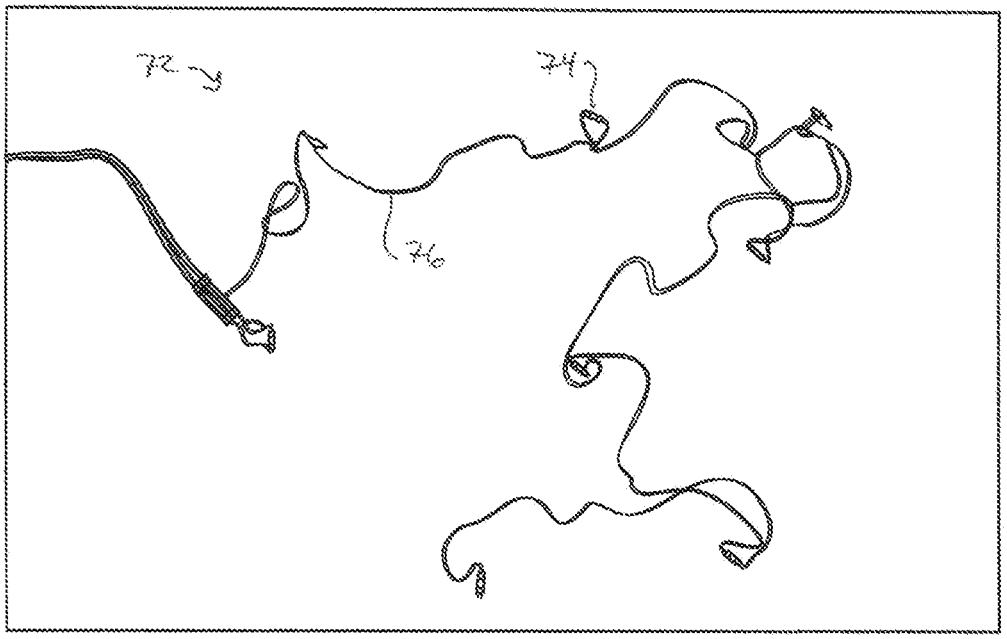
FIG. 6 is a perspective view of the light source wiring harness of the lighted stocking of FIGS. 1-4.

A light source wiring harness is indicated in general at 72 in FIG. 6. The wiring harness 72 includes a number of light sources 74, which are LED bulbs in the illustrated embodiment, operatively connected by electrical wire 76. While eight LED bulbs are illustrated in FIG. 6, and alternative number of light sources may be provided.

Figure 7:
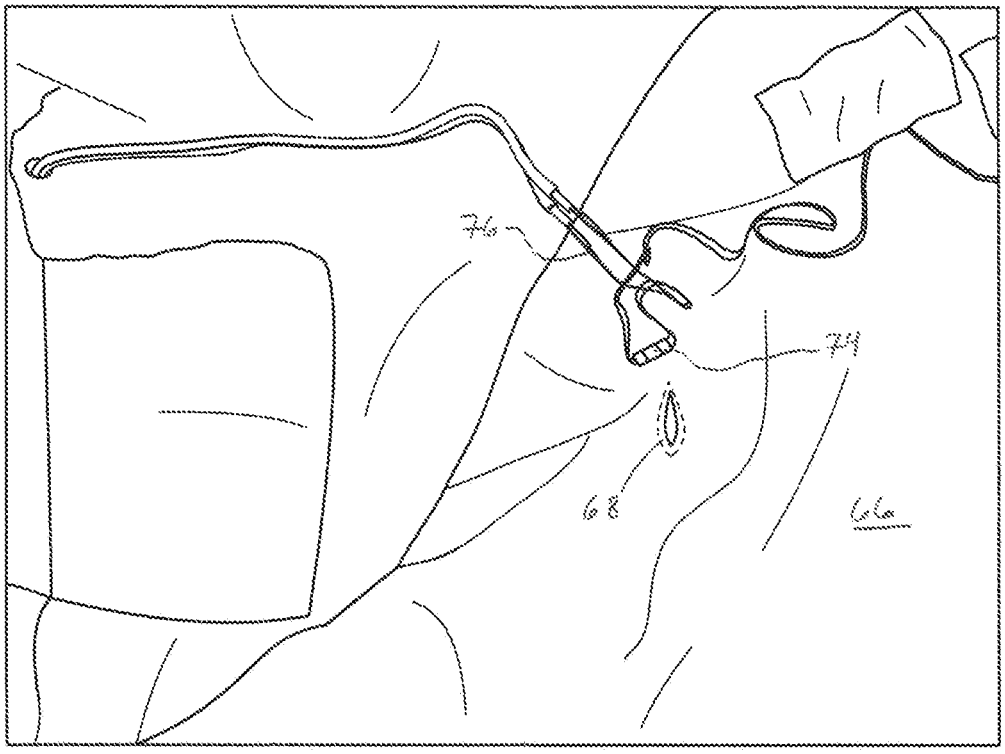
FIG. 7 is a perspective view illustrating a light source of the light source wiring harness of FIG. 6 prior to insertion into a light source aperture of the batting layer of FIG. 5.
Figure 8:
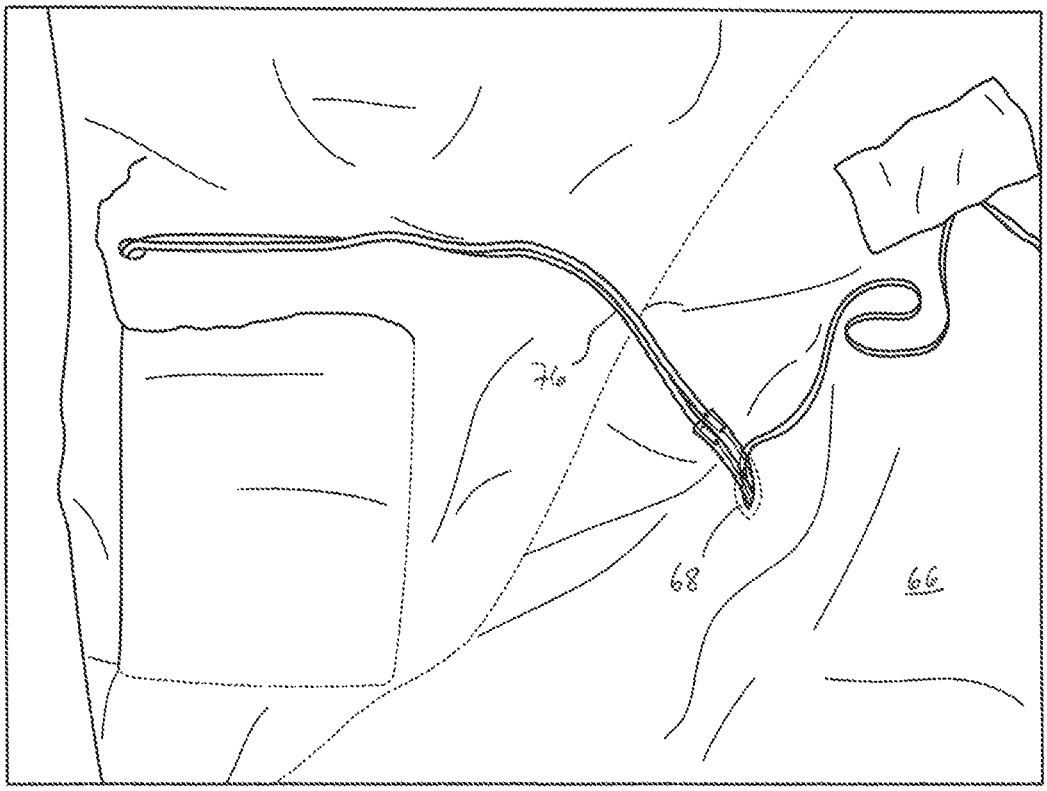
FIG. 8 is a perspective view illustrating a light source of the light source wiring harness of FIG. 7 after insertion into a light source aperture of the batting layer of FIG. 7.
Figure 9:
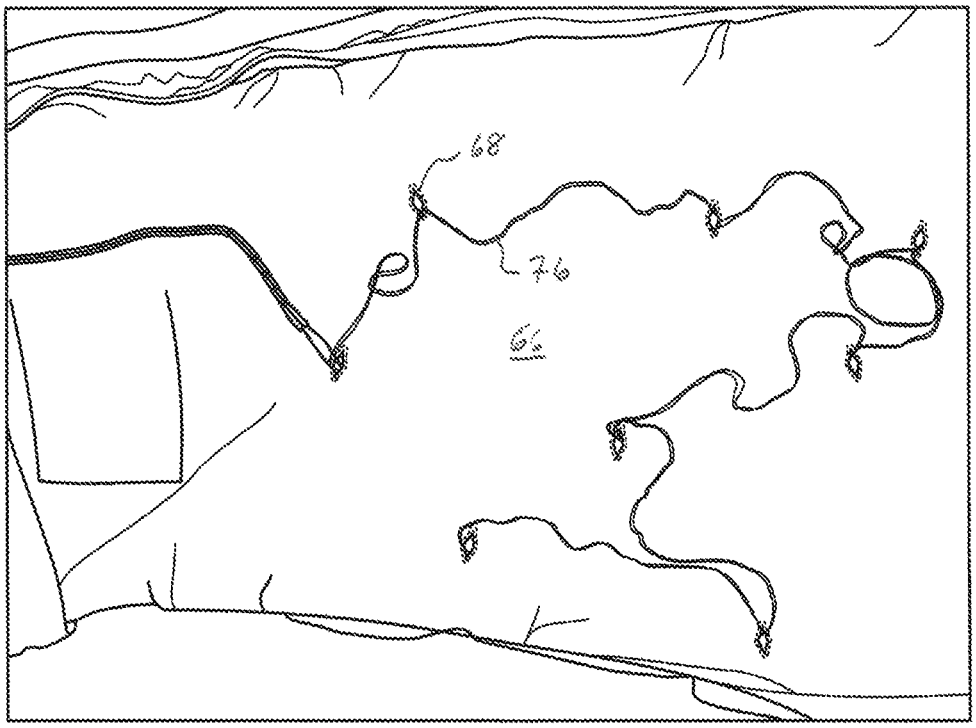
FIG. 9 is a perspective view illustrating the light sources of the light source wiring harness of FIG. 6 after insertion into the light source apertures of the batting layer of FIG. 5.

As illustrated in FIGS. 7-9, each light source 74 is inserted into a corresponding aperture 68 of the batting layer 66 so as to be positioned between the batting layer and the outer layer (28 of FIG. 1). With reference to FIG. 1, an end of the wire 76 is provided with a connector 78 that is routed through an opening 82 formed in the batting layer and the outer layer of the stocking body 22 so that an operative connection may be made between the battery pack 42 (FIG. 1) and LED bulbs 74 (FIGS. 6 and 7).

Figure 10:
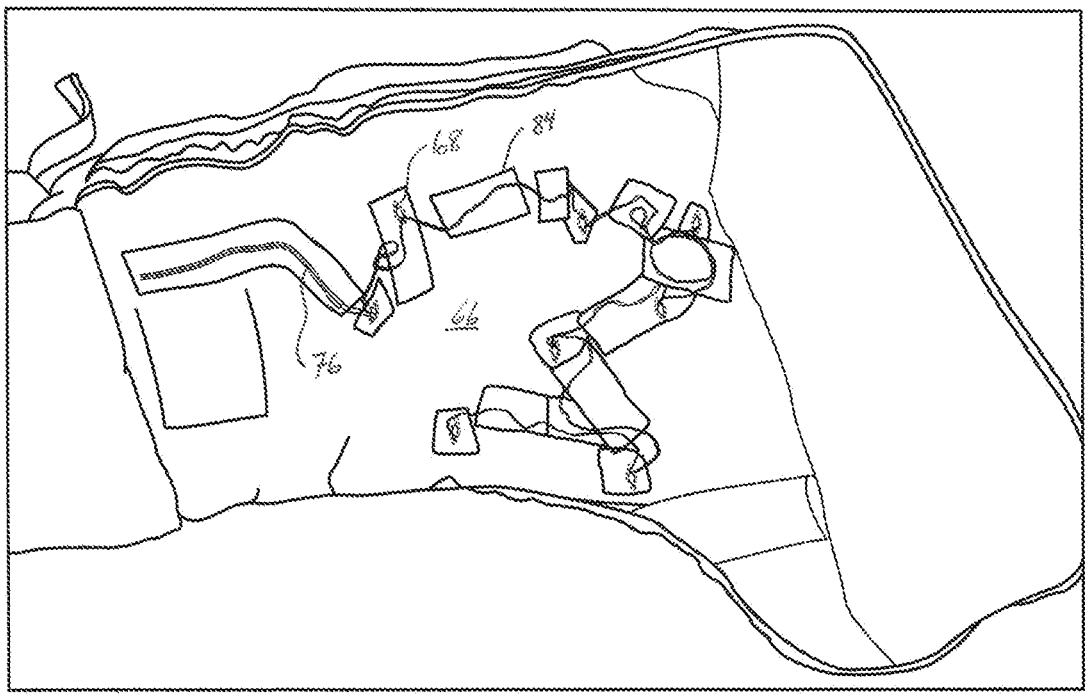
FIG. 10 is a perspective view of the light source wiring harness of FIG. 9 after being secured to the batting layer.

As illustrated in FIG. 10, the wiring 76 is secured to the batting layer 66 with tape 84. As a result, the LED bulbs are secured within the apertures 68. In an alternative embodiment, the wiring 76 may be sewn to the batting layer 66 or secured thereto by staples or other fastening arrangements known in the art.

After the light source wiring harness is secured within the stocking, the lining 64 (FIG. 4) is sewn into the stocking. As a result, the light source wiring harness is covered by the lining material so that the wiring and light sources are not damaged by items placed within the stocking or while the stocking interior is being accessed.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A lighted decorative article comprising:

a. an outer layer of material constructed of a sheer cloth;

b. a batting layer attached to the outer layer; the batting layer including a plurality of light source apertures;

c. a light source wiring harness including a plurality of light sources operatively connected by electrical wire, wherein the plurality of light sources are positioned within the plurality of light source apertures so as to be between the batting layer and outer layer and underneath the outer layer but not extending through the outer layer, the plurality of light sources being visible through the outer layer, and the electrical wire is secured to the batting layer;

d. a liner secured to the batting layer so as to cover the wire.

2. The lighted decorative article of claim 1 wherein the batting layer is attached to the outer layer by quilting.

3. The lighted decorative article of claim 1 wherein the light sources are light emitting diodes.

4. The lighted decorative article of claim 1 wherein the outer layer, batting layer and lining form a stocking body having an opening, and further comprising:

e. a battery pack operatively connected to the electrical wire;

f. a cuff attached to the body so as to at least partially surround the opening;

g. a battery pack holder configured to removably hold the battery when the cuff overlays a portion of the stocking body.

5. The lighted decorative article of claim 4 wherein the battery pack holder is a pocket positioned on the outer layer.

6. A method of manufacturing a lighted decorative article comprising the steps of:

a. forming a plurality of light source apertures in a batting layer;

b. securing the batting layer to an outer layer constructed of a sheer cloth;

c. inserting a plurality of light sources into the light source apertures of the batting layer so as to be between the batting layer and outer layer and underneath the outer layer but not extending through the outer layer, the plurality of light sources being visible through the outer layer;

d. securing wiring operatively connected to the plurality of light sources to the batting layer;

e. securing a lining to the batting layer so that the wiring is sandwiched between the batting layer and the lining.

7. The method of claim 6 wherein step b. includes quilting the batting layer to the outer layer.

8. The method of claim 7 further comprising the step of garment washing quilted batting layer and outer layer.

9. The method of claim 6 further comprising the step of attaching a battery pack to the wiring.

10. The method of claim 9 further comprising the step of securing the battery pack to the outer layer.

* * * * *